US005204585A

United States Patent [19]

Chen

[11] Patent Number: 5,204,585

[45] Date of Patent: Apr. 20, 1993

[54] ELECTRON BEAM DEFLECTION LENS FOR COLOR CRT

[75] Inventor: Hsing-Yao Chen, Barrington, Ill. 60010

[73] Assignee: Chunghwa Picture Tubes Ltd., Republic of China (Taiwan)

[21] Appl. No.: 874,503

[22] Filed: Apr. 27, 1992

[51] Int. Cl.[5] ..... H01J 29/46; H01J 29/56

[52] U.S. Cl. ..... 315/15; 315/382

[58] Field of Search ..... 315/14, 15, 382, 382.1; 313/414, 479, 371, 478

[56] References Cited

U.S. PATENT DOCUMENTS

| | | | |
|---|---|---|---|
| 2,072,957 | 3/1937 | McGee | 250/27.5 |
| 2,111,941 | 3/1938 | Schlesinger | 250/27.5 |
| 2,135,941 | 11/1938 | Hirmann | 250/27.5 |
| 2,185,590 | 1/1940 | Epstein | 250/155 |
| 2,202,631 | 5/1940 | Headrick | 250/163 |
| 2,213,688 | 9/1940 | Broadway et al. | 250/160 |
| 2,260,313 | 10/1941 | Gray | 250/27 |
| 2,827,592 | 3/1958 | Bramley | 315/14 |
| 2,888,606 | 5/1959 | Beam | 315/16 |
| 3,154,710 | 10/1964 | Parker | 313/75 |
| 3,735,190 | 5/1973 | Say | 315/13 |
| 3,887,830 | 6/1975 | Spencer | 313/443 |
| 4,468,587 | 8/1984 | Sluyterman | 313/413 |
| 4,980,606 | 12/1990 | Yamauchi et al. | 315/14 |
| 5,091,673 | 2/1992 | Shimoma et al. | 313/412 |
| 5,113,112 | 5/1992 | Shimoma et al. | 313/412 |

OTHER PUBLICATIONS

*A Wide-Deflection Angle* (114°) *Trinitron Color Picture Tube,* Yoshida et al., IEEE Chicago Spring Conference on BTR, Jun. 12, 1973.

*Primary Examiner*—Theodore M. Blum

*Attorney, Agent, or Firm*—Emrich & Dithmar

[57] ABSTRACT

An electron gun for a color cathode ray tube (CRT) includes a cathode, a low voltage beam forming region (BFR), and a high voltage deflection focus lens disposed in the beam deflection region of the CRT's magnetic deflection yoke for simultaneous and coincident focusing and deflection of the electron beams on the CRT's display screen. The deflection lens includes a first focus electrode either in the form of a cylindrical metal grid or a conductive coating disposed on the inner surface of the CRT's neck portion and extending into the magnetic deflection field. The deflection lens further includes a second focus electrode either in the form of a conductive coating or a frusto-conical metallic grid disposed on or immediately adjacent to the inner surface of the CRT's funnel portion intermediate the magnetic deflection yoke and the CRT's display screen. By positioning the electron gun's deflection focus lens within the deflection field, the deflection center of the electron beams is disposed within the focal point of the focus lens permitting the focus lens to operate as a deflection lens to not only focus the beam, but also increase beam deflection sensitivity. By reducing beam "throw distance" (fieldfree zone) and realizing a corresponding reduction in beam magnification and space charge effect, improved electron beam spot on the display screen is also provided. The focus lens increases the equivalent diameter of the main focus lens which reduces lens spherical aberration effect on the beams, while co-locating the beam focus and deflection regions also allows for shorter CRT length.

45 Claims, 10 Drawing Sheets

ELECTRON BEAM DEFLECTION LENS FOR COLOR CRT

FIELD OF THE INVENTION

This invention relates generally to multi-beam cathode ray tubes (CRTs) and is particularly directed to a electron beam deflection lens for use in the high voltage focus and magnetic deflection regions in a color CRT.

BACKGROUND OF THE INVENTION

Referring to FIG. 1, there is shown a lateral sectional view of a conventional color cathode ray tube (CRT) 10. The sectional view of FIG. 1 is taken down a vertical center-line through CRT 10 such that only elements of the CRT's center electron gun 11 are shown in the figure, it being understood that in an inline color CRT an outer electron gun is disposed on each side of the center electron gun. The electron guns are disposed within a sealed glass envelope 28 having a generally cylindrical neck portion 28*a*, a frusto-conical funnel portion 28*b*, and a display screen 14. Disposed in a sealed manner on an aft portion of the glass envelope's neck portion 28*a* is a plug-like connector 31 comprised of a plastic housing and a plurality of conductive pins 32 extending in a sealed manner from a distal end of the glass envelope's neck portion 28*a*. The combination of connector 31 and pins 32 is adapted for insertion in a socket for providing power and control signals to CRT 10. Disposed on an inner surface of display screen 14 is a phosphor layer 16 responsive to an electron beam incident thereon for providing a video image. The phosphor layer 16 is in the form of a large number of discrete phosphor elements arranged in groups of three for each of the primary colors, i.e., red, green and blue. A charged metal shadow mask 42 having a large number of apertures therein is disposed immediately adjacent to the phosphor layer 16. Each of the apertures in shadow mask 42 is aligned with a respective one of the aforementioned phosphor elements in phosphor layer 16 for allowing an electron beam to be incident upon the phosphor element as the electron beams are swept across the inner surface of display screen 14 in a raster-like manner. The charged shadow mask 42 serves as a color selection electrode, ensuring that each of the three electron beams lands only on its assigned phosphor elements, or deposits.

The multi-electrode electron gun 11 includes, in proceeding toward display screen 14, a low voltage beam forming region (BFR) 34, a symmetric prefocus lens 36 and a high voltage main focus lens 38. Energetic electrons are emitted by a plurality of heated cathodes K (only one of which is shown in the figure for simplicity) in the general direction of display screen 14. BFR 34 is aligned with cathodes K to receive the energetic electrons and form these electrons into a beam along an axis A—A', it being understood that outer electron beams are similarly formed on each side of the center electron beam 12 shown in dotted-line form. BFR 34 typically includes a $G_1$ electrode, a $G_2$ electrode, and a facing portion of a $G_3$ electrode. Electron beam 12 is then directed to the symmetric prefocus lens 36 which typically includes a $G_4$ electrode and facing portions of the $G_3$ electrode and a $G_5$ electrode. From the symmetric prefocus lens 36, the beam passes through a main focus lens 38 comprised of a $G_6$ electrode and a facing portion of the $G_5$ electrode. The main focus lens 38 focuses the electron beam 12 on the inner surface of display screen 14. Disposed about and engaging the $G_6$ electrode is a support, or convergence, cup 20. Attached to support cup 20 about its outer periphery are a plurality of contact clips, or bulb spacers, 22 which engage an adjacent inner surface of the neck portion 28*a* of the CRT's glass envelope 28. Support cup 20 provides support for the $G_6$ electrode and maintains electron gun 11 securely in position in the neck portion 28*a* of the CRT's glass envelope 28. Each of the aforementioned electrodes is coupled to and supported by glass beads (also not shown for simplicity) disposed in the glass envelope's neck portion 28*a*.

After being focused by the lens arrangement of electron gun 11, electron beam 12 passes through a magnetic deflection yoke 18 disposed about the frusto-conical funnel portion 28*b* of the CRT's glass envelope 28. A conductive layer (not shown) on the inner surface of the CRT's glass envelope 28 is electrically coupled to an anode button 30 extending through the CRT's glass envelope 28 and which, in turn, is coupled to an anode voltage $V_A$ source (which also is not shown in the figure for simplicity). The $G_6$ grid is generally comprised of a material exhibiting high magnetic permeability to shield the electron beams within the CRT's main focus lens 38 from the magnetic deflection field of yoke 18. The prior art therefore teaches the separation of the beam's electrostatic focus field and the magnetic deflection field.

The electron gun's main focus lens 38 is therefore typically comprised of the $G_5$ and $G_6$ electrodes and has a focal point 26 located on the electron beam axis A—A' generally intermediate these two charged electrodes. The main focus lens 38 formed of electrodes $G_5$ and $G_6$ also has an equivalent lens size, which is relatively small in diameter, for the typical electron gun 11 shown in FIG. 1 because of the relatively small diameter of these focus electrodes. Deflection yoke 18 typically is comprised of a ferrite core about which is wound two sets of current carrying conductors for establishing a timevarying magnetic field within the CRT 10 for deflecting electron beam 12 across the inner surface of the display screen 14 in a raster-like manner. In a conventional CRT, the electron beam is therefore first electrostatically focused and then magnetically deflected across the display screen 14. A beam deflection center is formed in a magnetic deflection region 40 such as on a deflection center axis D—D' shown in FIG. 1, with its location depending upon the size and shape of the core and conductive wire arrangement in the deflection yoke 18. As shown in the figure, the main focus lens 38 is displaced from the magnetic deflection region and the deflection center line D—D'. This spatial separation of the CRT's focus and deflection regions is one factor which establishes the CRT's length.

One problem with the prior art CRT 10 shown in FIG. 1 arises from the sequential focusing and deflection of the electron beams. For example, when the center electron beam 12 reaches the deflection center line D—D', the electrons have been accelerated to a high energy by the anode voltage $V_A$ which is applied to the $G_6$ electrode and is typically on the order of 25 kV. Because the amount of deflection for a given magnetic field is inversely proportional to the square root of electron beam voltage a large magnetic field is required to deflect the beam. This generally requires a larger deflection yoke and/or increased current in the yoke windings which gives rise to thermal dissipation problems and requires a larger yoke power supply. Therefore, prior art CRTs suffer from limited electron beam deflection sensitivity. High deflection sensitivity for the electron beam is particularly important in the current high resolution CRTs with higher deflection frequencies. In order to accommodate these faster deflection rates, Litz wire in the form of a bundle of twisted wires is frequently used to provide a greater surface area in taking advantage of the increased skin effect of these types of conductors. Unfortunately, Litz wires are substantially more expensive than a strand of conventional copper wire and of limited commercial value in consumer-type CRTs.

The present invention addresses the aforementioned limitations of the prior art by providing a deflection lens for a multi-beam electron gun in a color CRT which allows for simultaneous and co-located focusing and deflection of the CRT's electron beams. By deflecting the beam in a lower voltage region and positioning the electron beam deflection center within the focal point of the CRT's main focus lens, increased beam deflection sensitivity is realized, the length of the CRT as well as the diameter of its neck portion may be reduced, and lens magnification, electron beam space charge effect and lens spherical aberration are reduced for improved video image quality.

OBJECTS AND SUMMARY OF THE INVENTION

Accordingly, it is an object of the present invention to provide simultaneous and coincident electron beam focusing and deflection in a multi-beam, color CRT.

It is another object of the present invention is to provide increased deflection sensitivity for the electron beams in a color CRT by deflecting the beams while the beams are at a relatively low voltage (reduced beam velocity).

Yet another object of the present invention is to position the deflection center of the electron beams in a color CRT within the focal point of the CRT's main focus lens for improved deflection sensitivity of the beam.

A further object of the present invention is to provide electron beam deflection in a color CRT at reduced magnetic deflection yoke power and with a smaller yoke.

A still further object of the present invention is to increase the equivalent electron beam focus lens size in a multi-beam, color CRT for reducing the spherical aberration effect of the lens on the beams for improved electron beam spot (smaller in size and circular in shape) on the CRT's display screen.

It is yet another object of the present invention is to reduce electron beam "throw distance" (the electrostatic field-free zone from the CRT's focus lens to its display screen) for reducing space charge effects in the beam and improving video image quality on the CRT's display screen.

Still another object of the present invention is to shorten the length of a color CRT by either moving the main focus lens of the CRT's electron gun forward toward the CRT display screen or moving its magnetic deflection yoke rearward so as to co-locate the beam focus and deflection regions in the CRT.

Another object of the present invention is to reduce electron beam magnification in a multi-beam electron gun and to thereby improve video image quality in a color CRT.

A further object of the present invention is to reduce the length of a color CRT's neck portion by moving the CRT's electron gun forward toward its display screen by locating the gun's main focus lens in the electron beam deflection region of the CRT.

Still another object of the present invention is to provide a high voltage deflection lens in a color CRT which focuses each electron beam to a small, circular spot on the CRT's display screen and increases beam deflection sensitivity by allowing for beam deflection at lower beam voltages and then increases beam energy following deflection and prior to incidence on the display screen's phosphor elements.

These objects of the present invention are achieved and the disadvantages of the prior art are eliminated by an inline electron gun for directing a plurality of electron beams along an axis onto a display screen in a color cathode ray tube (CRT) having a neck portion and a frusto-conical funnel portion disposed intermediate said neck portion and said display screen, the CRT further including a magnetic deflection yoke disposed generally intermediate said neck and funnel portions for providing a magnetic deflection region for deflecting the electron beams across the display screen in a raster-like manner, the electron gun comprising: a source of energetic electrons; a low voltage beam forming arrangement disposed adjacent the source of energetic electrons and within the neck portion of the CRT for forming the energetic electrons into a plurality of electron beams along the axis; and a high voltage focus lens disposed in the magnetic deflection region and intermediate the beam forming arrangement and the display screen for providing a common aperture electrostatic focus region for the plurality of electron beams for focusing the electron beams on the display screen, wherein the magnetic deflection region and the electrostatic focus region overlap and are coincident.

This invention further contemplates a deflection lens for use in a color cathode ray tube (CRT) having a glass envelope including a neck portion, a frusto-conical funnel portion and a display screen, wherein a plurality of inline electron beams are directed onto a phosphor layer disposed on an inner surface of the display screen for providing a video image, and wherein the electron beams are directed through a magnetic deflection region formed by a deflection yoke disposed generally intermediate the neck and funnel portions of the CRT's glass envelope for deflecting the electron beams across the display screen in a raster-like manner, a deflection lens comprising: a first charged electrode disposed intermediate the deflection yoke and the display screen and on or immediately adjacent to an inner surface of the funnel portion of the CRT's glass envelope and charged to a voltage $V_A$, said first charged electrode having a first common aperture through which the electron beams pass; and a second charged electrode disposed in the neck portion of the CRT's glass envelope and charged to a voltage $V_F$ and having a second common aperture through which the electron beams pass, wherein the first and second electrodes apply an electrostatic focus field to the electron beams for focusing the beams on the display screen, and wherein the electrostatic focus field is disposed in the magnetic deflection region for simultaneous and coincident focusing and deflection of the electron beams on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

There are primarily three characteristics of an electrostatic focusing lens which determine the diameter, or spot size, of the electron beam incident upon the display screen of a CRT. The goal, of course, is to provide a sharply focused electron beam incident on the display screen. The three primary characteristics of the electrostatic focusing lens are its magnification, spherical aberration and space charge effect.

The magnification factor is given by the following expression:

$$d_M = d_o M = \frac{q}{p}\sqrt{\frac{V_o}{V_A}}\, d_o \qquad (1)$$

where:

q = distance from the center of the main lens to display screen (or "throw distance");

p = distance from the object plane to the center of the main lens;

$V_o$ = voltage at the object side of the main lens;

$V_A$ = voltage at the image side of the main lens; and $d_o$ = object size.

By increasing p and reducing q the present invention reduces the magnification factor $d_M$ as described below.

The spherical aberration characteristic is given by the expression:

$$d_s = C_s\Theta^3 \qquad (2)$$

where:

$C_s$ = coefficient of spherical aberration; and $\Theta$ = electron beam's divergence angle (or beam half angle).

Electron beam spot size growth occurs due to the fact that a point source focused by a lens cannot again be focused to a point. The further away an electron ray is from the focusing lens optical axis, the larger the lens focusing strength preventing the electron ray from again being focused to a point source.

The space charge effect on electron beam spot size is given by the expression:

$$d_{sp} \alpha \Theta^{-1} \quad (3)$$

This growth factor in electron beam spot size arises from the repulsive force between like charged electrons.

In general, the overall spot size from all of the above described factors can be expressed as $$d_{TOTAL} = \sqrt{(d_M + d_{SP})^2 + d_S^2} \quad (4)$$

The present invention reduces each of the aforementioned $d_M$, $d_{sp}$ and $d_s$ factors as described below and provides an improved overall beam spot size.

Figure 2:
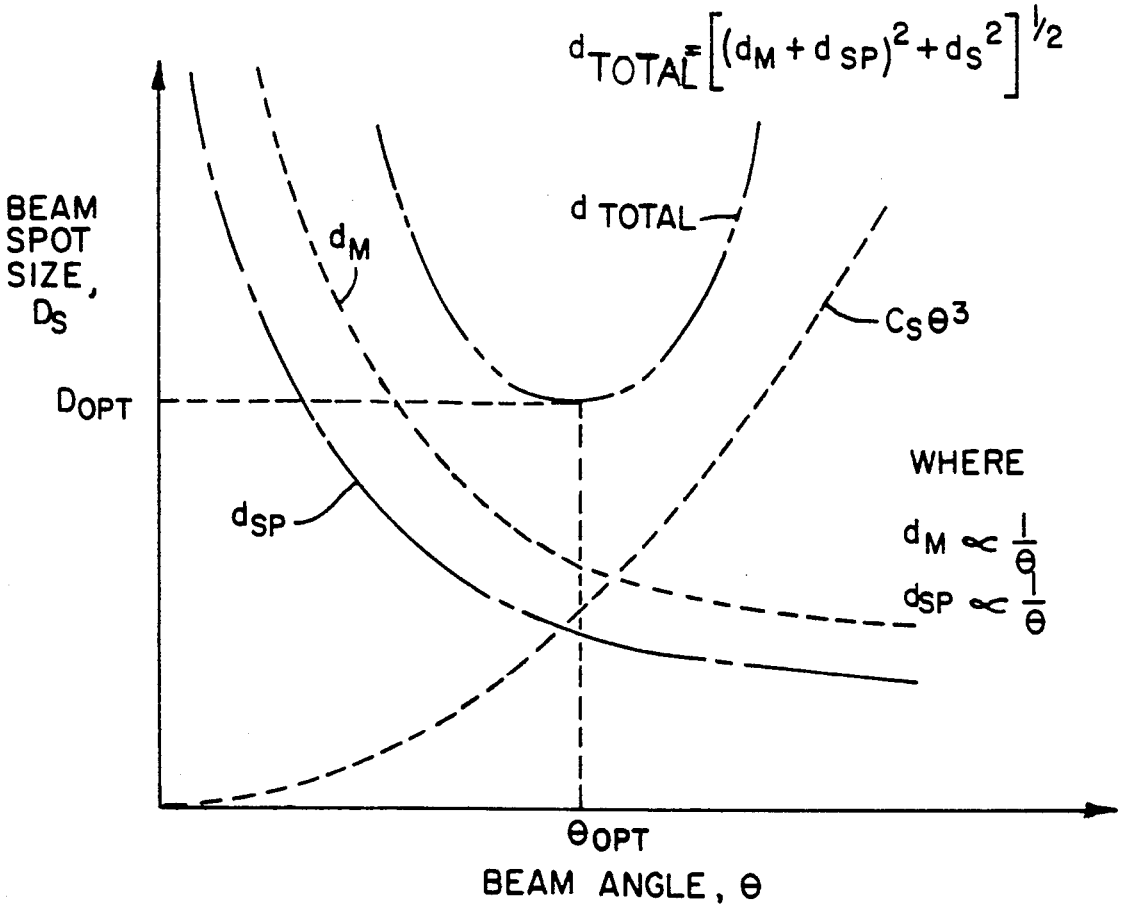
FIG. 2 shows the variation of electron beam spot size ($D_s$) with beam angle ($\Theta$), in terms of the three relevant factors of magnification ($d_M$), spherical aberration ($d_{sp}$), and space charge effect ($d_x = C_s\theta^3$)
Figure 3:
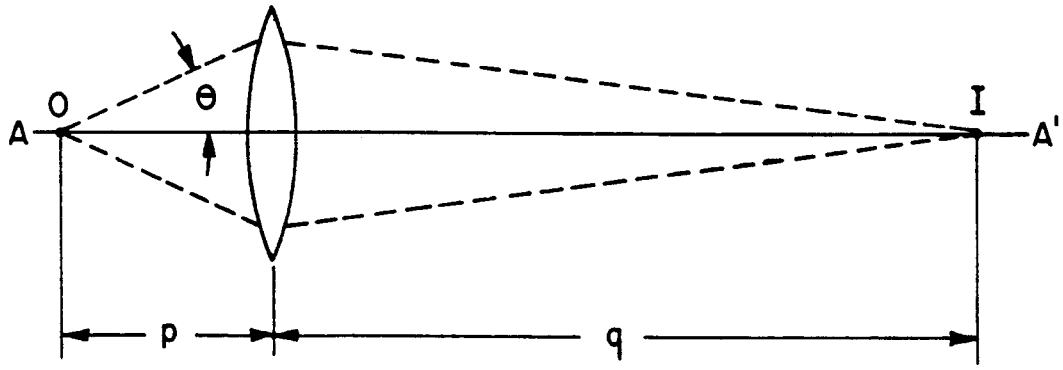
FIG. 3 is a simplified schematic diagram illustrating electron beam angle ($\Theta$) relative to the beam axis A—A'.

FIG. 2 shows the variation in electron beam spot size ($D_s$) with beam angle ($\Theta$), in terms of the three aforementioned factors of magnification ($d_M$), spherical aberration ($d_s$), and space charge effect ($d_{sp}$). With $d_{total}$ representing electron beam spot size with all three aforementioned factors included, it can be seen that $d_{total}$ is minimum at $\Theta_{opt}$ with $D_{opt}$. Beam angle $\Theta$ along the electron lens axis A—A' is shown in FIG. 3.

The electron beam is typically generated in a so-called beam forming region (BFR) of the electron gun. The BFR can be considered as an electron optical system separate from the electron gun's main lens for producing an electron beam bundle tailored to match the specific main lens of the electron gun.

Figure 4:
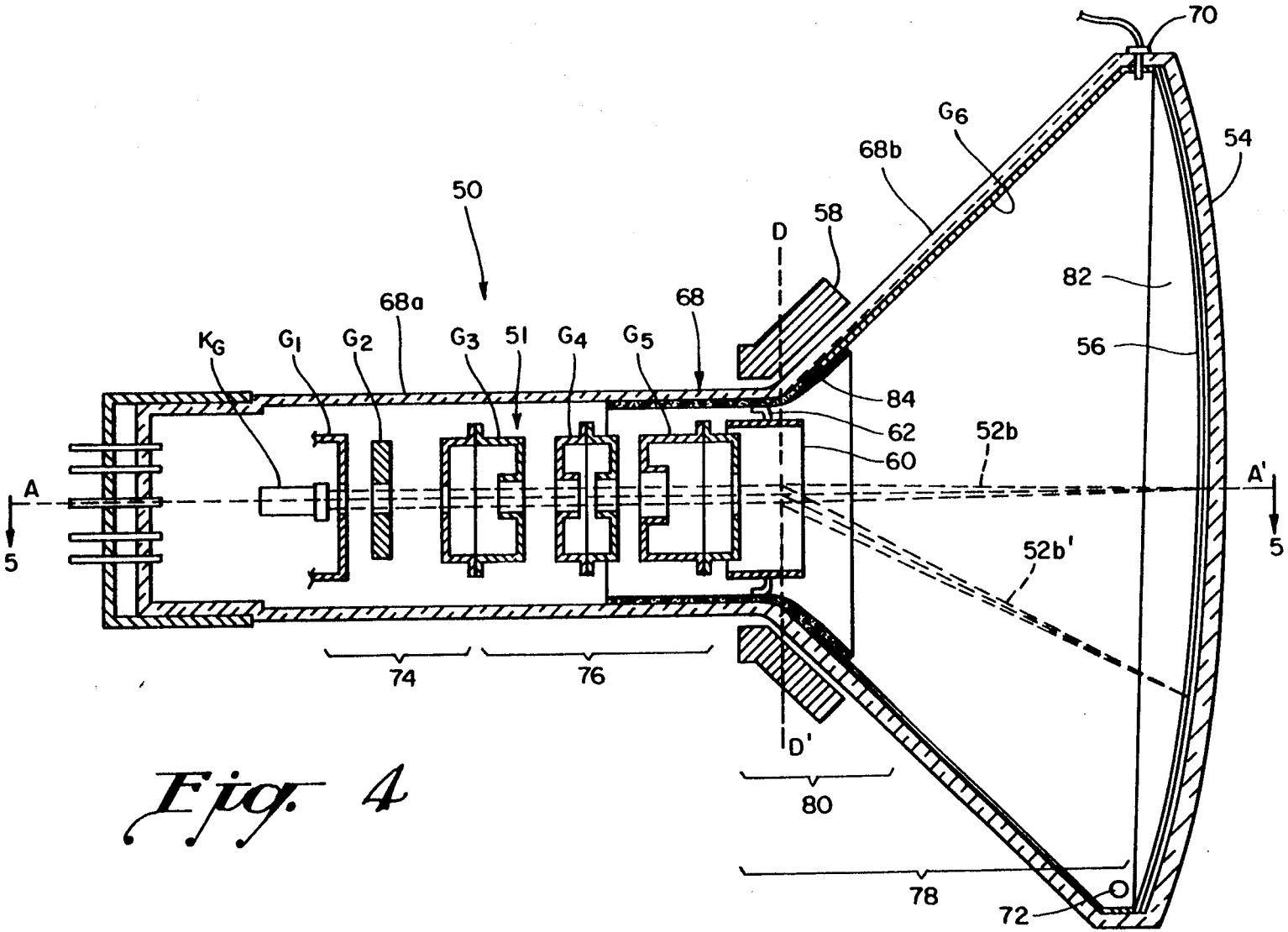
FIG. 4 is a top lateral sectional view of an electron gun in a CRT incorporating one embodiment of an electron beam deflection lens in accordance with the present invention, wherein the deflection lens includes an electrode in the form of a conductive coating on the inner funnel portion of the CRT's envelope.

Referring to FIG. 4, there is shown a simplified lateral sectional view of an electron gun 51 for use in a color CRT 50 in accordance with one embodiment of the present invention. Before beginning a detailed description of the present invention, it should be emphasized that although the electron gun described below includes six charged electrodes, the present invention is not limited to use in this type of electron gun, but may be employed in virtually any type of multibeam electron gun in a color CRT. As in the prior art CRT shown in FIG. 1, the inventive electron gun 51 in CRT 50 includes a plurality of cathodes which are shown in the top sectional view of FIG. 5 which is taken along site line 5—5 in FIG. 4 as elements $K_R$ ( red), $K_G$ (green) and $K_B$ (blue). Each of the three cathodes $K_R$, $K_G$ and $K_B$ emits energetic electrons when heated into a low voltage beam forming region (BFR) 74 comprised of a $G_1$ control electrode, a $G_2$ screen electrode and a facing portion of a $G_3$ electrode. Each of the $G_1$, $G_2$ and $G_3$ electrodes, as are the other electrodes in electron gun 51 discussed below, is coupled to an appropriate voltage source (not shown for simplicity) for charging the electrodes to a desired potential. Typically, the cathodes $K_R$, $K_G$ and $K_B$ operate at approximately 150V, the $G_1$ control electrode at ground potential, and the $G_2$ screen electrode at approximately 600V. The $G_3$ electrode is typically electrically interconnected to a $G_5$ electrode (although this is not shown in the figures for simplicity) and operates at about 7kV and the $G_4$ electrode is typically electrically interconnected to a $G_2$ electrode which operates at approximately 600V. Each of the $G_1$, $G_2$ and $G_3$ electrodes includes at least one set of three apertures, where each aperture is disposed along an electron beam axis for passing a respective electron beam toward a phosphor coating 56 on the inner surface of the CRT's display screen 54.

In FIG. 4, the center electron beam provided by the $K_G$ cathode for producing the color green on the display screen 54 is shown in dotted-line form and designated as element number **52*b*. The electron gun axis is designated as A—A', it being understood that each of the outer electron beams 52*a* and 52*b* also has its own beam axis extending from an outer cathode toward the CRT's display screen 54. The $G_2$ screen electrode is in the general form of a flat plate, while the $G_3$ electrode includes three apertures on its high voltage side and three apertures on its low voltage side with pairs of apertures on the high and low voltage sides aligned to pass a respective electron beam. The $G_4$ electrode in combination with facing portions of the $G_3$ electrode and the $G_5$ electrode forms a symmetric prefocus lens 76 in electron gun 51. A support, or convergence, cup 60 electrically coupled and physically attached to the $G_5$ electrode provides support and secure positioning for the electron gun 51 within CRT 50, it being understood that the various aforementioned electrodes are coupled to and maintained in position by conventional means such as glass rods which are not shown for simplicity. A plurality of bulb spacers 62 attached to and extending from support cup 60 engage a resistive coating 84 (described below) disposed on an inner surface of the CRT's glass envelope 68. Resistive coating 84 extends into the neck portion 68*a* of glass envelope 68 and prevents arcing between the $G_5$ electrode and support cup 60 combination and a $G_6$ electrode. Resistive coating 84** also serves as a high impedance voltage divider between the anode and focus grids.

The CRT's glass envelope 68 has a neck portion **68*a* and a frusto-conical funnel portion 68*b*. Disposed on a forward portion of the funnel portion 68*b* of glass envelope 68 is the CRT's display screen 54. Disposed on the inner surface of display screen 54 is the phosphor coating 56 generally in the form of a plurality of discrete phosphor elements arranged in groups of three where each electron beam is incident upon one of the three elements in each group for producing a respective one of the primary colors of red, green and blue. An anode button 70 is coupled to an anode voltage $V_A$ source (not shown for simplicity) and extends through the CRT's glass envelope 68. Anode button 70 allows the anode voltage $V_A$ to be provided to various electrodes within the CRT's glass envelope 68 as described herein. A getter 72 disposed within the CRT's glass envelope absorbs residual gases therein. Getter 72** is comprised of a conventional getter material.

Disposed about the CRT's glass envelope 68 generally between its neck portion **68*a* and its frusto-conical funnel portion 68*b* is a magnetic deflection yoke 58. Magnetic deflection yoke 58 is conventional in design and operation and includes a generally toroidal-shaped core typically comprised of ferrite material and a large number of electrical conductor windings disposed about the core for producing a magnetic field within the CRT 50 in the vicinity where the three electron beams leave the $G_5$ electrode and travel toward the display screen 54. Deflection yoke 58 displaces the electron beams in unison over the display screen 54 in a raster-like manner as previously described. Deflection yoke 58** forms a deflection region 80 characterized as having an electron beam deflection center located on line D—D' within the CRT 50. Each of the electron beams is deflected by the magnetic deflection yoke 58 from its respective beam axis as shown, for example, by the deflected center electron beam 52b' in FIG. 4.

Each of the three electron beams is focused on the display screen 54 by means of a deflection focus lens 78 comprised of the aforementioned $G_5$ electrode and a $G_6$ electrode in accordance with the present invention. The $G_6$ electrode is disposed immediately adjacent to or on the inner surface of the frusto-conical funnel portion 68b of the CRT's glass envelope 68. In the embodiment shown in FIGS. 4 and 5, the $G_6$ electrode is in the form of a conductive coating deposited on the inner surface of the glass envelope 68 in an annular shape symmetrical about axis A—A'. The $G_6$ electrode is preferably in the form of a metallic or carbon-based coating comprised of any of a variety of conventional conductive coating compositions well known to those skilled in the relevant art. The $G_6$ electrode preferably extends from a forward portion of the CRT's glass envelope 68 rearward to a location within the deflection yoke 58. The $G_6$ electrode is electrically coupled to the anode button 70 for receiving the anode voltage $V_A$. A resistive coating 84 is deposited on an inner portion of the glass envelope 68 so as to extend from the envelope's neck portion 68a to its frusto-conical funnel portion 68b. Resistive coating 84 is disposed over an aft portion of the $G_6$ electrode and provides a high impedance current leakage path for preventing high voltage arcing between the $G_5$ electrode and bulb spacer 62 combination and the $G_6$ conductive coating electrode. With the $G_5$ electrode and the $G_6$ conductive coating electrode extending into or immediately adjacent to the magnetic deflection yoke 58, focusing of the three electron beams by the deflection focus lens 78 is performed within a beam focus region which is co-located with the beam deflection region 80 in accordance with the present invention. The three electron beams are therefore simultaneously and coincidentally focused and deflected within CRT 50 in accordance with the present invention. With the deflection center of the three electron beams located on the beam deflection center line D—D', the focal point of the deflection focus lens 78 comprised of the $G_5$ and $G_6$ electrodes can be represented as a point 66 on electron beam axis A—A'. The electron beam deflection center is thus located within the focal point 66 of the deflection focus lens 78 for increased electron beam deflection sensitivity as described below. Co-locating the focus and deflection regions within CRT 50 is accomplished by either moving the beam focus region toward display screen 54, or by moving the beam deflection region toward the neck portion 68a of the CRT's glass envelope 68. Co-locating the focus and deflection regions within CRT 50 also allows for shortening the length of the CRT.

Figure 1:
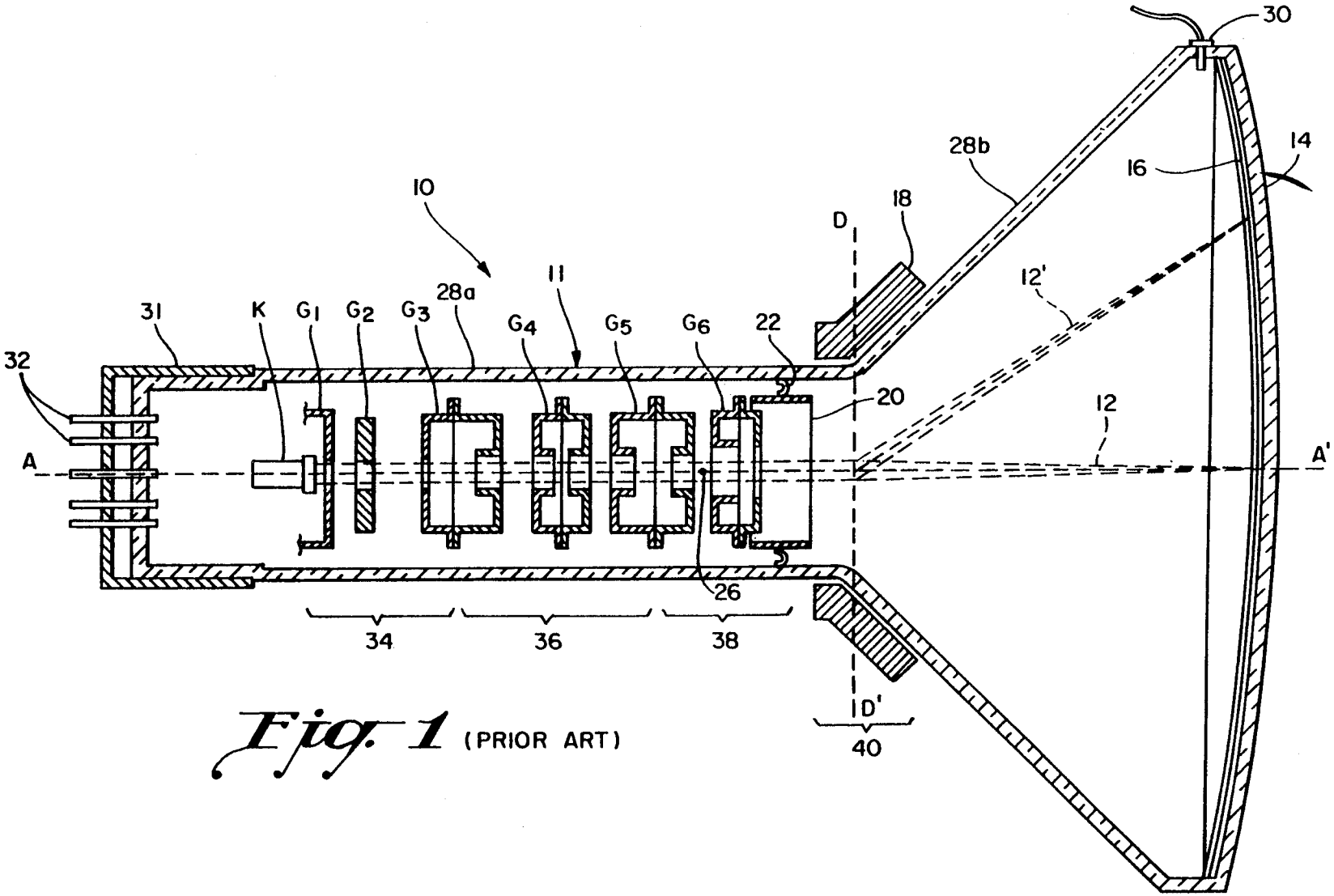
Fig. 1 (PRIOR ART)
FIG. 1 is a simplified lateral sectional view of a prior art color CRT incorporating a conventional electron gun.
Figure 5:
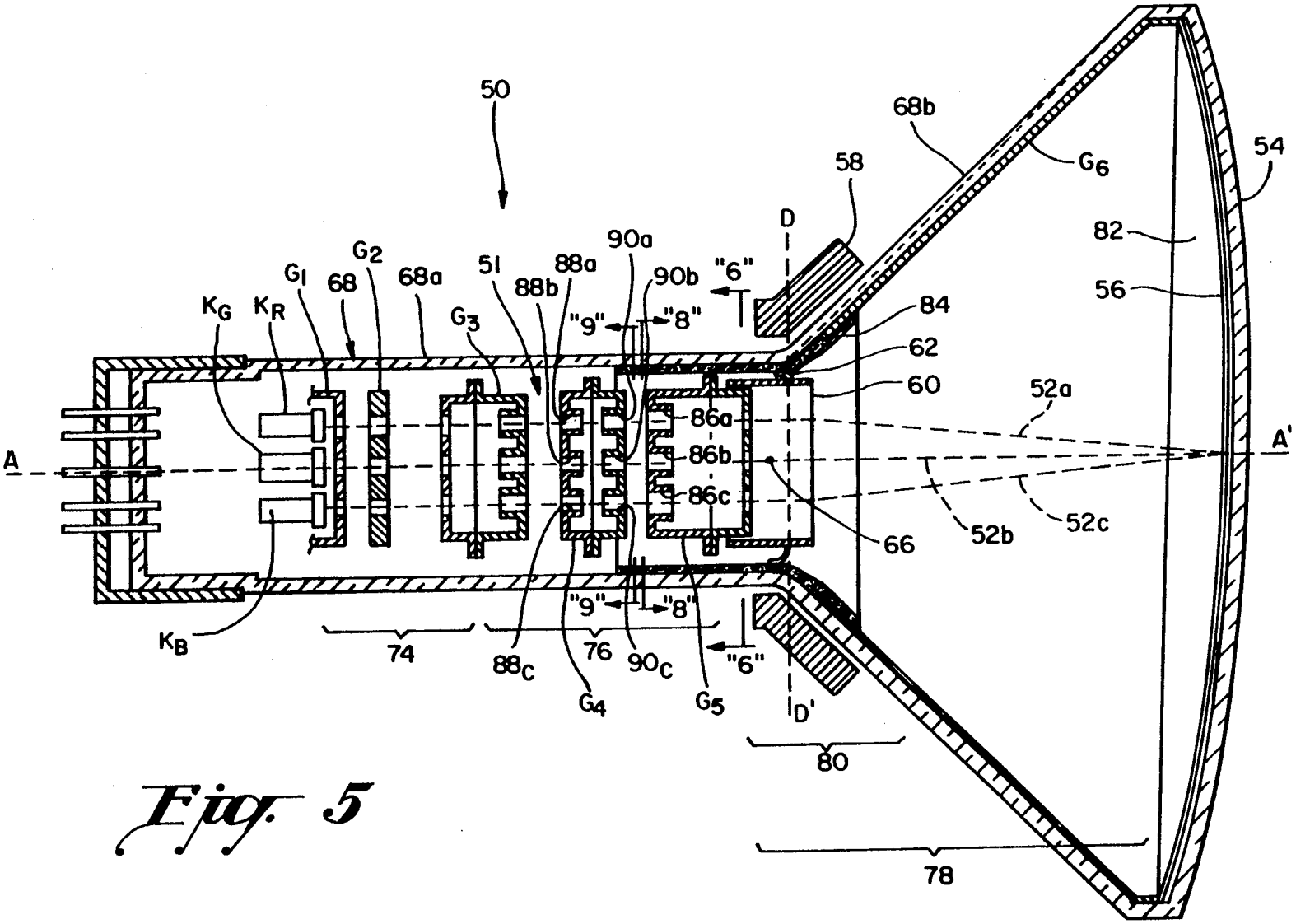
FIG. 5 is a top sectional view of the CRT and electron gun of FIG. 4 taken along site line 5—5 therein.

A comparison of the main focus lens comprised of the $G_5$ and $G_6$ electrodes in the inventive electron gun 51 of FIGS. 4 and 5 with the main focus lens of the prior art electron gun 11 of FIG. 1 shows that the main focus lens of the inventive electron gun has a larger diameter than that of the prior art electron gun. By increasing the effective size of the main focus lens, the present invention reduces electron beam spherical aberration and improves the electron beam spot on the CRT's display screen.

While the $G_6$ electrode is preferably in the form of a conductive coating disposed on the inner surface of the frustoconical funnel portion 68b of the CRT's glass envelope 68, the $G_6$ electrode may assume other forms. For example, the $G_6$ electrode may be a frusto-conical shaped thin metallic grid disposed on or in closely spaced relation to the inner surface of the glass envelope's funnel portion 68b. The frusto-conical metallic grid may be maintained in position by various means such as an appropriate attachment coating well known to those skilled in the relevant art for maintaining the metallic grid in position within CRT 50.

While FIG. 4 shows electron beam focusing on the CRT's display screen 54, the top sectional view of FIG. 5 shows the convergence of the red, green and blue electron beams 52a, 52b and 52c on the CRT's display screen. As previously explained, as the three electron beams 52a, 52b and 52c are displaced across the CRT's display screen 54, the inline alignment of the three electron beams gives rise to electron beam aberration and defocusing particularly when the three electron beams are deflected from axis A—A'.

The $G_4$ and $G_5$ electrodes are configured to minimize misconvergence of the three electron beams 52a, 52b and 52c. The $G_4$ electrode includes on its high voltage side first, second and third beam passing apertures 90a, 90b and 90c as well as three corresponding inline apertures 88a, 88b and 88c on its low voltage side. Each electron beam is directed through an aligned pair of apertures in the $G_4$ electrode. In facing relation to apertures 90a, 90b and 90c and respectively aligned therewith are apertures 86a, 86b and 86c in the low voltage side of the $G_5$ electrode. For purposes of this discussion, the $G_5$ electrode is presumed to be maintained at a higher voltage than the $G_4$ electrode. The three electron beams $52_a$, $52_b$ and 52c are directed through aligned pairs of adjacent apertures in facing portions of the $G_4$ and $G_5$ electrodes. Thus, aligned apertures 86a and 90a pass the red electron beam, while aligned apertures 86b and 90b pass the green electron beam, and aligned apertures 86c and 90c pass the blue electron beam.

Figure 6:
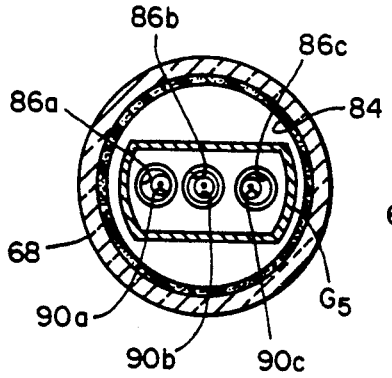
FIG. 6 is a sectional view of the CRT and electron gun shown in FIG. 5 taken along site line 6—6 therein.

Referring to FIG. 6, there is shown a sectional view of the color CRT 50 and electron gun 51 shown in FIG. 5 taken along site line 6—6 therein. FIG. 6 shows the relative position of facing, aligned apertures in the $G_4$ and $G_5$ electrodes along the three electron beam axes for correcting for electron beam misconvergence on the display screen. Each of the three apertures 90a, 90b and 90c in the $G_4$ electrode is aligned along and centered on a respective electron beam axis. Similarly, center aperture 86b in the $G_5$ electrode is aligned with and centered on the axis of the center electron beam 52b. However, as particularly shown in FIG. 6, the two outer apertures 86a and 86c in the $G_5$ electrode are displaced outwardly relative to the axes of the two outer electron beams 52a and 52c, respectively. Concentric alignment of the center apertures 86b and 90b provides a substantially symmetrical electrostatic beam focus field between the $G_4$ and $G_5$ electrodes. However, the off-axis pairs of aligned outer apertures 86a, 90a and 86c, 90c cause an asymmetric electrostatic focus field to be applied to the two outer electron beams 52a and 52c resulting in improved convergence of the two outer electron beams on the center electron beam 52b at the CRT's display screen. The convergence correction arrangement described above is for the case where $G_5$ is maintained at a higher voltage than $G_4$. In the case where $G_4$ is maintained at a higher voltage than $G_5$, the alignment and relative size of the apertures would be reversed. For example, where $G_4$ is maintained at a higher voltage than $G_5$, the larger apertures would be in the high voltage side of the $G_4$ electrode and the smaller apertures would be in the low voltage side of the $G_5$ electrode. In addition, the two outer apertures in the high voltage side of the $G_4$ electrode would be displaced outward along the horizontal beam axis, while the two outer apertures in the low voltage side of the $G_5$ electrode would be on the axis of a respective outer electron beam. Moreover, while this electron beam convergence correction arrangement is described in terms of the $G_4$ and $G_5$ electrodes, it could be incorporated in another pair of adjacent electrodes such as the $G_3$ and $G_4$ electrodes equally as well.

This approach for providing an asymmetrical electrostatic focus field between adjacent electrodes in an electron gun is well known to those skilled in the relevant art. Other techniques for compensating for electron beam misconvergence arising from the inline electron gun configuration may also be used in the present invention. For example, the $G_5$ electrode may be split into two or three pieces and used to form a dynamic electrostatic quadrupole. In this case, a dynamic voltage $V_d$ is applied to the bottom and top portions of the thus divided $G_5$ electrode while a fixed voltage is applied to the center portion of the $G_5$ electrode for forming a quadrupole field to compensate static misconvergence of the inline electron beams. Such an arrangement is disclosed in an article entitled "*Quadrupole Lens for Dynamic Focus and Astigmatism Control in an Elliptical Aperture Lens Gun*" by Shirai et al., published in SID 87 Digest, at page 162. Various dynamic quadrupole arrangements in an electron gun for a color CRT are also disclosed in U.S. Pat. No. 5,036,258 to Chen et al. Other misconvergence correction arrangements well known to those skilled in the relevant art may be used in the electron gun 51 of the present invention which is not limited to any specific misconvergence correction approach.

Figure 7:
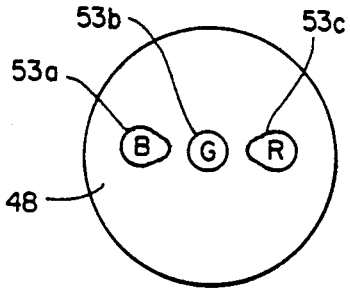
Fig. 7 (PRIOR ART)
FIG. 7 shows a partial elevation view of a display screen of a prior art CRT having a common, large aperture electron lens system for the three electron beams illustrating electron beam spot distortion for the two outer electron beams which is corrected by the present invention.

Referring to FIG. 7, there is shown an elevation view of a portion of a display screen 48 of a prior art color CRT having a common, large aperture electron lens system for the three electron beams showing the three electron beam spots 53*a*, 53*b* and 53*c*, where the two outer electron beam spots are distorted. As shown in FIG. 7, inner portions of the two outer electron beam spots 53*a* and 53*c* include an inwardly directed extension, or flare, caused by over-focusing of the outer rays of the two outer electron beams as they transit through a common lens. The non-circular cross-sections of the two outer electron beam spots 53*a*, 53*c*, which is termed spherical aberration, arises from the horizontal asymmetrical electrostatic focus field applied to the two outer electron beams.

Figure 8:
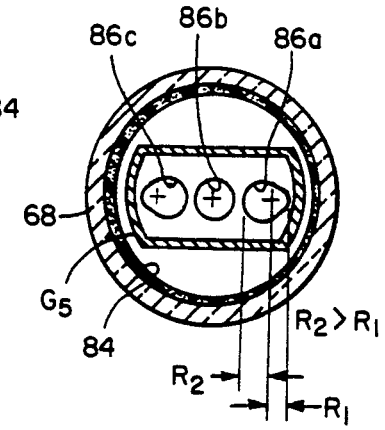
FIG. 8 is a sectional view of the electron gun shown in the CRT of FIG. 5 taken along site line 8—8 therein showing an elevation view of the high voltage side of the $G_5$ electrode.
Figure 10:
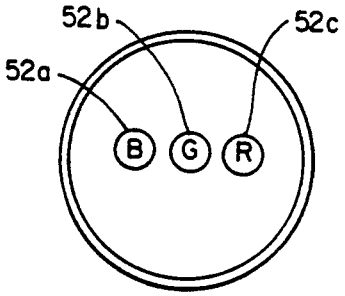
FIG. 10 shows a partial elevation view of a display screen in the CRT of the present invention illustrating electron beam spot correction provided by the present invention.

In order to correct for the asymmetrical outer electron beams 52*a*, 52*c*, the two outer apertures 86*a* and 86*c* in the $G_5$ electrode are provided in one embodiment of the present invention with an asymmetrical shape as shown in the sectional view of FIG. 8 taken along site line 8—8 in FIG. 5. From FIG. 8, it can be seen that each of the outer apertures 86*a* and 86*c* in the $G_5$ electrode has a somewhat irregular, curvilinear shape. More specifically, an inner portion of each of apertures 86*a*, 86*c* which is disposed toward the center beam aperture 86*b* extends a distance $R_2$ from the axis of the outer electron beam. Similarly, the facing outer portion of each of the outer electron beam apertures 86*a*, 86*c* extends a distance $R_1$ from the centerline, or axis, of the electron beam. As shown in FIG. 8, $R_2 > R_1$ and the inner portion of each of the outer electron beam apertures 86*a*, 86*c* has a larger radius of curvature than the facing outer portion of the aperture. Each of the outer electron beam apertures 86*a*, 86*c* is thus horizontally asymmetric about the axis of its associated electron beam, with the beam passing aperture extending further inward, or toward the electron gun centerline, than outward from the electron beam axis. The horizontal asymmetry of each of the outer electron beam apertures 86*a*, 86*c* in the $G_5$ electrode about the axis of its associated electron beam allows each of these apertures to focus the two outer electron beams in the form of rotationally symmetric, or circular, electron beam spots on the CRT's display screen in accordance with the present invention as shown in FIG. 10 for the three electron beams 52*a*, 52*b* and 52*c*. In this manner, each of the outer electron beam apertures 86*a* and 86*c* applies an asymmetric field to its associated electron beam to compensate for the asymmetric electrostatic focus field applied to the electron beams. An arrangement for compensating for the asymmetric electrostatic field of an electron beam focus lens in forming circular electron beam spots on the CRT's display screen as described in co-pending application, Ser. No. 885,880, entitled "Electron Beam Shaping Aperture in Low Voltage, Field-Free Region of Electron Gun," filed in the name of the present inventor.

Figure 9:
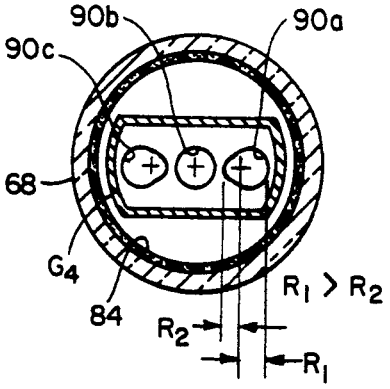
FIG. 9 is a sectional view of an electron gun as shown in the CRT of FIG. 5 taken along site line 9—9 therein illustrating another embodiment of the apertured low voltage side of the $G_4$ electrode in accordance with the present invention.

Referring to FIG. 9, there is shown a sectional view taken along site line 9—9 in FIG. 5 of a portion of the electron gun 51 in the CRT 50 shown therein. The sectional view of FIG. 9 is a plan view of the high voltage side of the $G_4$ electrode in the electron gun 51. The configuration of the apertures in the $G_4$ electrode shown in FIG. 9 is for the case where the $G_4$ electrode is maintained at a lower voltage than the $G_5$ electrode. In this case, the two outer apertures 90*a* and 90*c* in the low voltage side of the $G_4$ electrode are provided with asymmetrical shapes. For example, the outer portions of each of the outer electron beam apertures 90*a*, 90*c* have a larger radius of curvature and extend further from the beam axis than the facing inner portions of the apertures. Thus, $R_1 > R_2$ to allow the two outer electron beam apertures 90*a*, 90*c* to apply a horizontal asymmetric electrostatic field to the outer electron beams which compensates for the horizontal asymmetric electrostatic focusing field applied by the common focus lens. The asymmetrical shape of the two outer apertures 90*a*, 90*c* in the $G_4$ electrode shown in FIG. 9 is the reverse of the asymmetry of the two outer apertures 86*a*, 86*c* in the $G_5$ electrode as shown in FIG. 8 because of the difference in relative voltages at which these two adjacent electrodes are maintained in these two embodiments.

Figure 11:
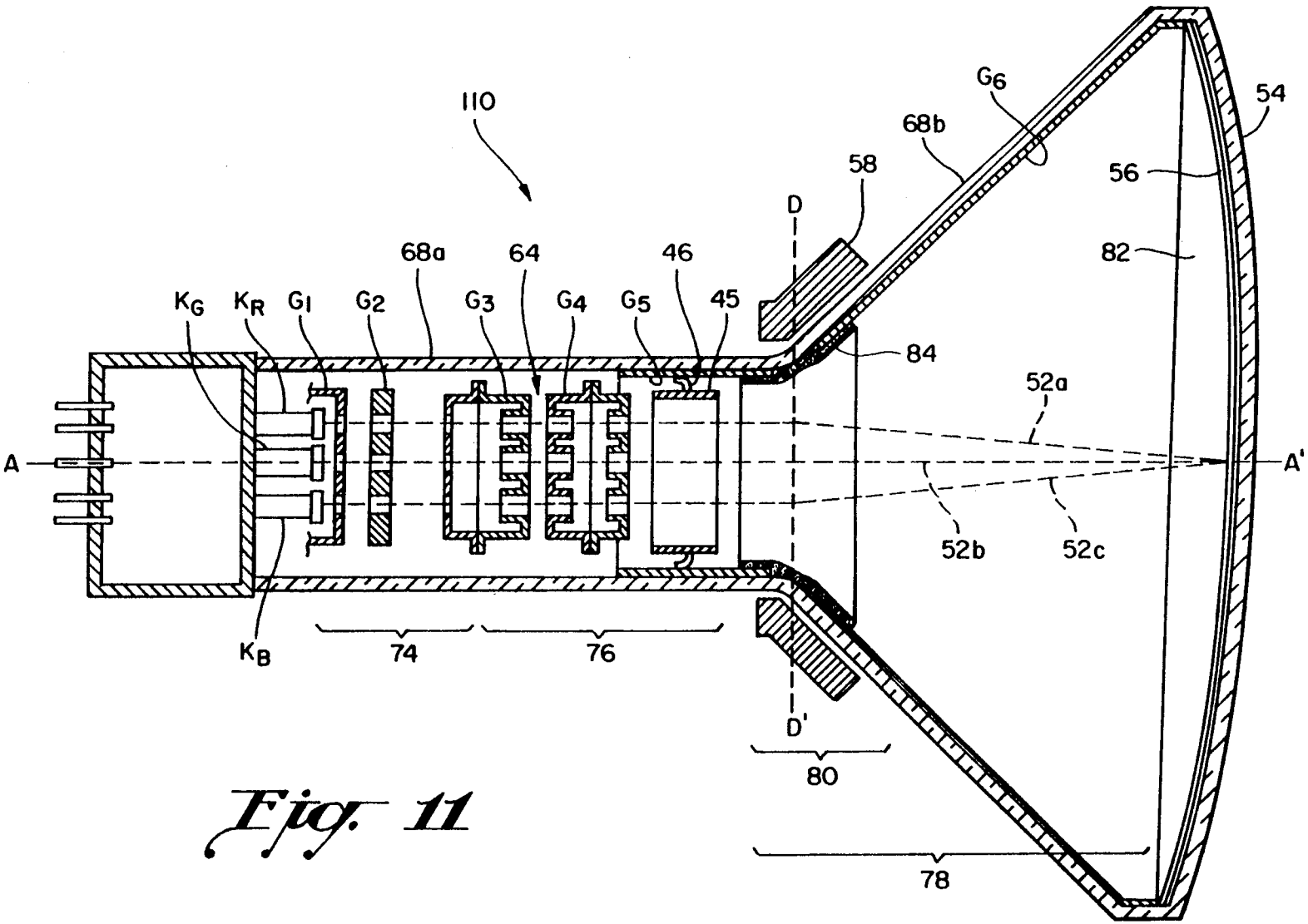
FIG. 11 is a top sectional view of an electron gun in a color CRT in accordance with another embodiment of the present invention.

Referring to FIG. 11, there is shown another embodiment of a CRT 110 incorporating an electron gun 64 in accordance with the principles of the present invention. FIG. 11 is a top sectional view through CRT 110 similar to that shown in FIG. 4 of the first embodiment of the invention, where common element numbers are used in the two figures to identify the same elements performing the same function in substantially the same manner. The difference between the electron gun 64 shown in the CRT 110 of FIG. il and the electron gun 51 shown in the CRT 50 of FIG. 4 lies in the configuration of the $G_5$ electrode. In the electron gun embodiment of FIG. 11, the $G_5$ electrode is, similar to the $G_6$ electrode, in the form of a conductive coating disposed on the inner surface of the neck portion 68*a* of the CRT's glass envelope 68. The $G_5$ electrode extends into the beam deflection region 80 and is closely spaced relative to the magnetic deflection yoke 58. As in the previous embodiment, the electron beam focus region formed by the $G_5$ and $G_6$ electrodes comprising the deflection focus lens 78 overlaps the beam deflection region 80. The $G_5$ electrode is preferably comprised of a metallic or carbon-based conductive material similar to that of the $G_6$ electrode. A resistive coating 84 is disposed on the inner surface of the glass envelope and extends into the neck portion 68*a* of the glass envelope. Resistive coating 84 either covers adjacent edges of the $G_5$ and $G_6$ electrodes or extends above one electrode and below an adjacent, facing edge of the other electrode. Resistive coating 84 prevents arcing between the $G_5$ and $G_6$ electrodes. The $G_6$ electrode is coupled to the anode button (which is not shown in FIG. 11 for simplicity) for charging to the anode voltage $V_A$ as previously described for the embodiment shown in FIGS. 4 and 5. As in the previous embodiment, the $G_5$ electrode is charged by a suitable voltage source (not shown for simplicity) to a potential on the order of 7 kV. A charged support cup 45 is electrically coupled via bulb spacers 46 to the $G_5$ electrode for applying an appropriate voltage to this electrode.

Figure 12:
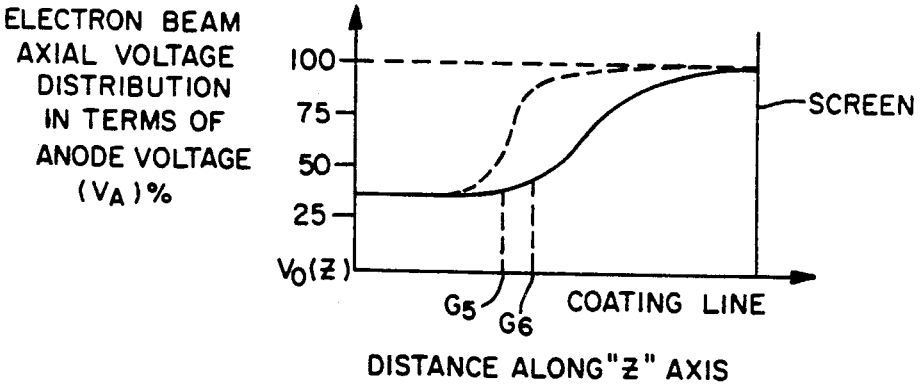
FIG. 12 is a graphic illustration comparing the variation of voltage along the axis of an electron beam in a prior art electron gun with voltage variation along electron beam axis in the electron gun of the present invention.

Referring to FIG. 12, there is shown a graphic illustration of the variation of voltage along the axis of the electron beam in either of the inventive electron guns shown in FIGS. 5 and 11. As shown in FIG. 12, the voltage along the electron beam axis increases from approximately 25% of the anode voltage ($V_A$) in the vicinity of the $G_5$ electrode to essentially the full value of $V_A$ at the CRT's display screen 54. The electron beam axial voltage increases in the region of the $G_6$ electrode which is disposed immediately adjacent to or on the inner surface of the frusto-conical funnel portion of the CRT's glass envelope. From FIG. 12 it can be seen that the electron beam is at a relatively low voltage when deflected in the vicinity of adjacent portions of the $G_5$ and $G_6$ electrodes to provide increased beam deflection sensitivity. The electron beam voltage is then increased by the $G_6$ electrode subsequent to beam deflection to realize the high energy necessary to excite the phosphor coating 56 on the inner surface of the CRT's display screen 54. By deflecting the electron beam while at a lower voltage, the magnetic deflection field may be reduced permitting the use of lower current in the deflection yoke or a smaller, simpler deflection yoke.

Figure 13A:
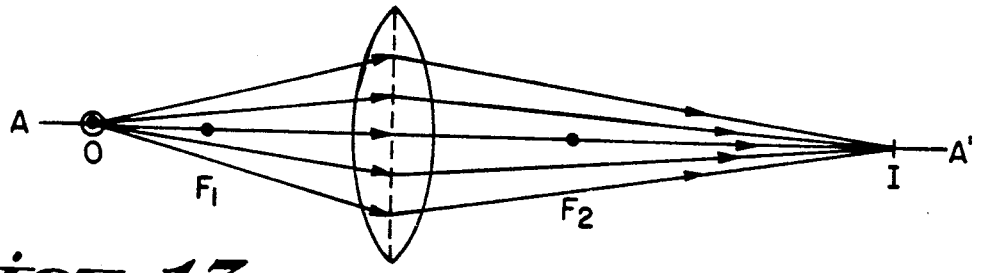
FIGS. 13*a*, 13*b* and 13*c* are simplified ray diagrams illustrating the focusing effect of a lens on an object positioned respectively outside the lens focal point, at the lens focal point, and within the lens focal point.
Figure 13B:
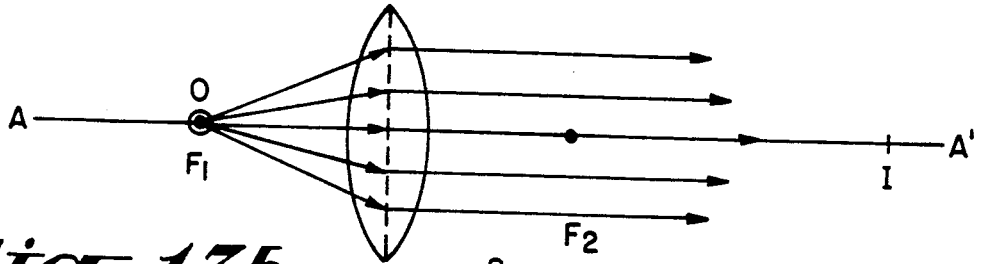
Figure 13C:
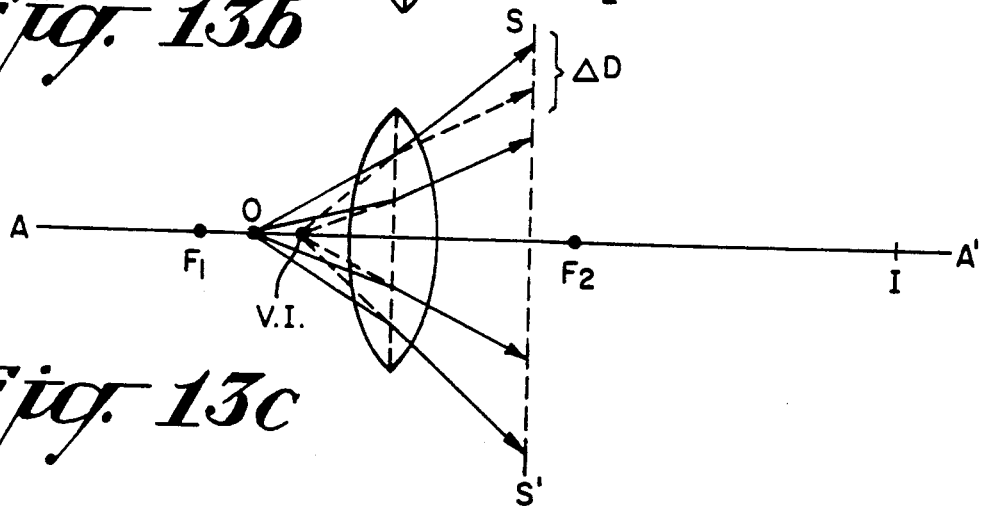

Referring the FIGS. 13*a*, 13*b* and 13*c*, the operation of the present invention in increasing electron beam deflection sensitivity will now be explained. Each of FIGS. 13*a*, 13*b* and 13*c* is a simplified ray diagram of an electron beam passing through an ideal focus lens (without aberration). In FIG. 13*a*, the object (0) is located beyond, or outside of, a first focal point ($F_1$) of the lens. In this case, the electron beam rays are focused at an image point (I) beyond a second focal point ($F_2$) of the focus lens. In general, where the object O is located beyond the focal point of the lens, the rays are focused toward the lens axis A—A'.

Referring to FIG, 13*b*, there is shown the case where the object O is located at the first focal point $F_1$ of the lens. In this case, the rays are directed parallel to the lens axis A—A' and form a collimated beam along the axis. The image I is located at infinity and the rays are not focused on axis A—A'.

Referring to FIG. 13*c*, there is shown an arrangement in accordance with the present invention where the object O is located within the focal point $F_1$ of the focus lens. In this case, a virtual image (V.I.) is formed on axis A—A' between the object O and the lens. Each of the rays emanating from the object O is refracted outwardly, or away from axis A—A', in alignment with the virtual image location. Where the dotted-line S—S' represents a CRT display screen, it can be seen that each of the rays is deflected a distance $\Delta D$ outward from axis A—A' from a projection of a corresponding ray emanating from the object 0. More specifically, it can be seen that for the upper-most ray emanating from object O the ray is refracted upwardly a distance $\Delta D$ from where it would intersect display screen S-S' if the lens were not present. This distance $\Delta D$ represents an increase in deflection sensitivity of the beam by locating the electron beam's deflection center at the object location O and within the focal point $F_1$ of the focus lens. This increased deflection sensitivity allows for reduced performance requirements of the magnetic deflection yoke. For example, a smaller deflection yoke may be used or a lower deflection current may be employed permitting the use of a smaller deflection power supply. This increased deflection sensitivity is particularly important in high resolution CRTs now being developed which utilize much higher deflection frequencies. The increased deflection sensitivity of the present invention permits these higher deflection frequencies to be achieved more easily at reduced cost.

Figure 14A:
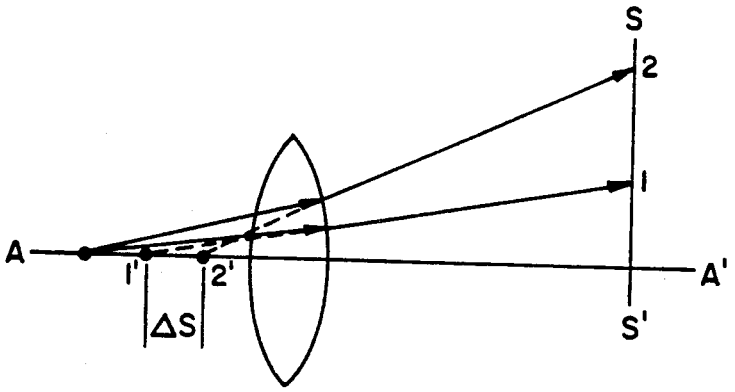
FIG. 14*a* is a simplified ray diagram illustrating the "dynamic" deflection center effect of the deflection lens of the present invention which must be accommodated in exposing the phosphor elements on the CRT display screen to activating light.

Referring to FIG. 14*a*, there is shown a simplified schematic diagram illustrating the "dynamic" deflection center effect which occurs during simultaneous and coincident focusing and deflection of the electron beams in accordance with the present invention. As shown in FIG. 14*a* , electron beam rays for different deflection angles originate from slightly different locations along lens axis A—A' due to the deflecting lens refraction effect on the electron beam rays. For example, an electron beam ray incident upon point 1 on screen S—S' appears to originate from point 1' on the lens axis. An electron beam ray incident upon point 2 on screen S—S' appears to originate from point 2' on the focus deflection lens axis A—A'. I order to accommodate this dynamic deflection center effect on the electron beams, it is necessary to expose, or activate, the phosphor elements on the inner surface of the CRT's display screen in accordance with this dynamic deflection center effect.

Figure 14B:
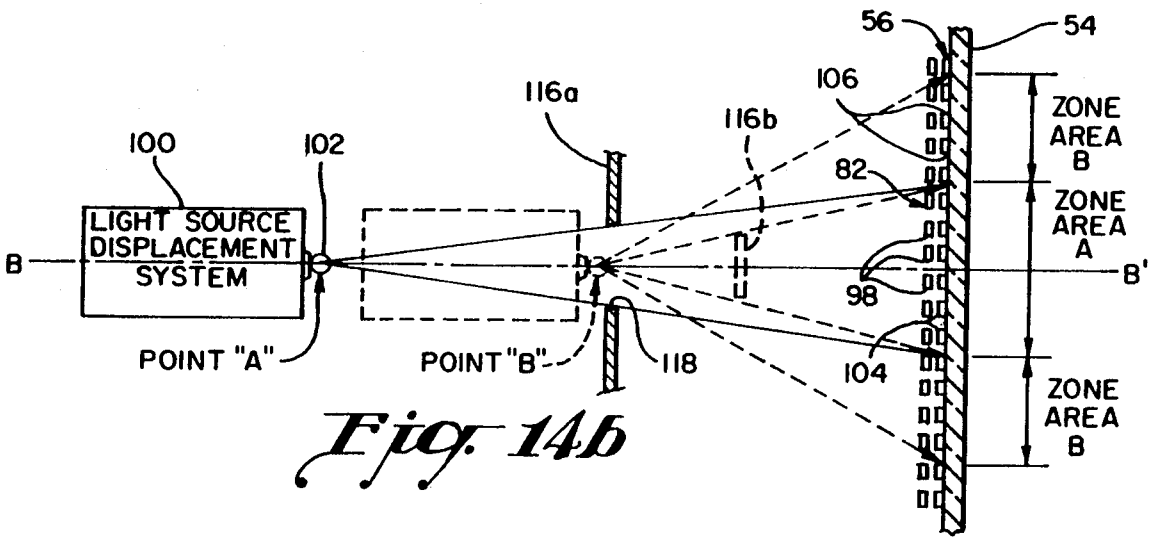
FIG. 14*b* is a simplified schematic diagram of an arrangement for exposing the phosphor elements on the inner surface of the CRT's display screen to light for activating the phosphor elements for use with the present invention.

Referring to FIG. 14*b*, there is shown a simplified schematic diagram of an arrangement for exposing the phosphor elements within the coating 56 on the inner surface of the CRT's display screen 54. As previously described, a color selection electrode in the form of a shadow mask 82 is disposed in closely spaced relation to the phosphor coating 56. Electrons from the three electron beams transit the apertures 98 within shadow mask 82 and are incident upon predetermined areas within the phosphor coating 56. The inline arrangement and spacial separation of the three electron beams requires precise alignment between each of the apertures 98 within shadow mask 82 relative to the three electron beams as they are incident upon phosphor coating 56. The path of a phosphor element activating light beam must be coincident with that of a corresponding electron beam incident on the same phosphor element during CRT operation. The arrangement of FIG. 14*b* is concerned with exposing the aforementioned predetermined locations in the phosphor coating 56 to light for activating these phosphor elements so that they are responsive to an electron beam incident thereon for giving off light. The thus illuminated phosphor elements are arranged in groups of three to accommodate the three primary colors of red, green and blue.

The phosphor element illuminating, or activating, arrangement shown in FIG. 14*b* includes a light source displacement system 100 coupled to a light source 102 for illuminating predetermined areas, or zones, on the phosphor coating 56. The light source displacement system 100 is moveable toward and away from the display screen 54 along an axis B—B' transverse to a plane through the center of the display screen. Because the present invention involves co-locating the beam deflection and focus regions and positioning the beam deflection center within the focal point of the electron gun's main focus lens, the position of the exposed elements within phosphor coating 56 will be different than in a conventional color CRT electron gun where the deflection and focus regions are maintained separate and the deflection center is always located at a fixed position. The overlapping focus and deflection regions in the electron gun of the present invention must be accommodated in activating the phosphor elements because the deflection lens causes the beam deflection center to move along the Z-axis which must be taken into account. This is accomplished by moving the light source 102 relative to the shadow mask 82 and the display screen 54. The light source 102 may be displaced either continuously or in a stepwise manner toward the display screen 54, with the light source either remaining on or turned on periodically to illuminate various groups of three phosphor elements. In the stepwise approach, the display screen 54 may be divided into zones to activate all phosphor elements in a given zone at the same time. A variable size apertured ray blocker 116*a* may be used in combination with an axial ray blocker 116*b* to prevent light illumination of unintended areas of the display screen during activation of the phosphor elements. In order to accommodate the change in the relative positions of the three electron beams as they are incident upon display screen 54, the light source displacement system 100 provides for linear displacement of the light source 102 relative to the display screen. With light source 102 at point A and with the axial ray blocker 116*b* removed, light rays are directed through an aperture 118 within ray blocker 116*a* and onto phosphor elements 104 in zone area A for activating the phosphor elements on this portion of the display screen 54. Light source 102 is then turned off and moved to point B on axis B—B' by means of the light source displacement system 100. The axial ray blocker 116*b* is then positioned on axis B—B' intermediate the apertured ray blocker 116*a* and display screen 54. Turning on light source 102 at position B results in illumination and activation of phosphor elements 106 in zone area B on the inner surface of display screen 54, with axial ray blocker 116*b* preventing light from being incident upon the previously activated phosphor elements within zone area A. In the embodiment shown in FIG. 14*b*, aperture 118 and the axial ray blocker 116*b* are circular as is zone area A, while zone area B is also circular and defined by inner and outer radii. By varying the size of aperture 118 and/or the spacing of axial ray blocker 116*b* intermediate display screen 54 and the apertured ray blocker 116*a*, various zone areas on display screen 54 may be selectively activated. Other arrangements for activating the phosphor elements 104 on display screen 54 will be apparent to those skilled in the relevant art, some involving the continuous displacement of and illumination by the light source 102, others involving the stepwise displacement of the light source and periodic illumination of selective phosphor elements. The selective phosphor element activating arrangement accommodates the movement of the electron beam deflection center along the axis of the electron gun caused by the deflection lens of the present invention.

Figure 15:
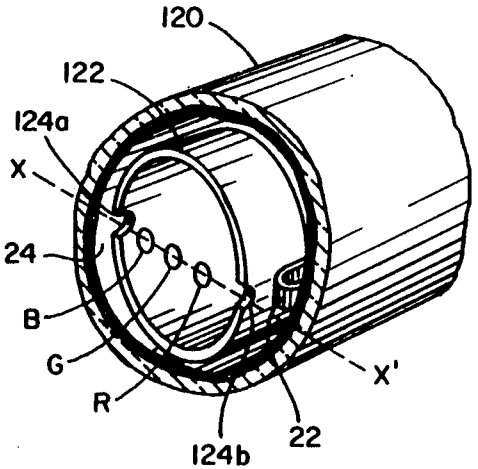
FIG. 15 is a perspective view of a cutaway portion of a CRT showing a support cup attached to the $G_5$ grid of an electron gun in accordance with the present invention where the support cup is adapted to correct for the asymmetric focusing of the two outer electron beams.

Referring to FIG. 15, there is shown a partially cutaway portion of a CRT 120 showing a perspective view of a bulb spacer 122 disposed on a forward portion of a $G_5$ electrode (not shown in the figure). Bulb spacer 122 has been modified with the incorporation of facing lateral slots 124*a* and 124*b* in opposed lateral portions of the bulb spacer for applying an asymmetric electrostatic field to the two outer electron beams R and B for correcting for electron beam spherical aberration. The lateral slots 124*a* and 124*b* in the forward portion of bulb spacer 122 increase the strength of the electrostatic field applied to outer rays of the two outer electron beams R and B for reducing electron beam ray crossover and eliminating inward over-focusing of the two outer prior art electron beam spots shown in FIG. 7 and discussed above.

Figure 16:
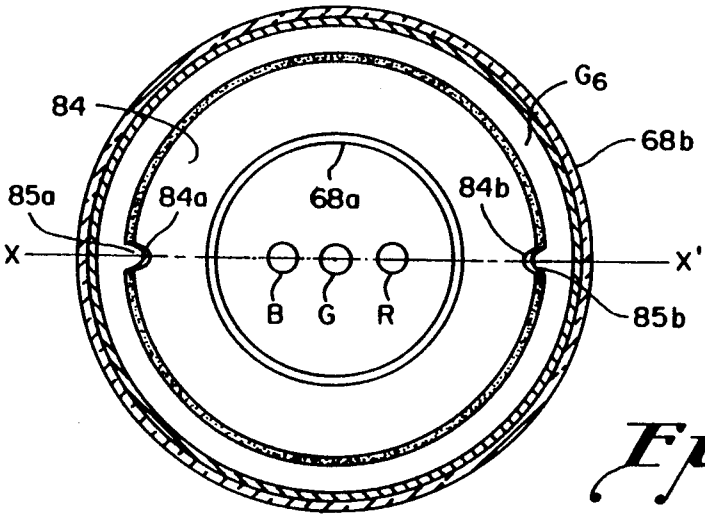
FIG. 16 is a sectional view of a color CRT incorporating an electron gun in accordance with the present invention illustrating a conductive coating $G_6$ electrode disposed on the inner surface of the funnel portion of the CRT's glass envelope where the $G_6$ electrode has been modified to correct for the asymmetric focusing of the two outer electron beams.

Referring to FIG. 16, there is shown a transverse sectional view of a CRT taken along the CRT axis from the display screen end thereof of another embodiment for correcting for electron beam spherical aberration. As shown in FIG. 16, the resistive coating 84 is provided with facing lateral notches 84*a* and 84*b* for exposing rearward extensions 85*a* and 85*b* of the $G_6$ electrode. The rearward extensions 85*a*, 85*b* of the $G_6$ electrode increase the electrostatic field applied to the outer rays of the two outer electron beams R and B for reducing electron beam ray crossover. By reducing electron beam ray crossover, the inward extensions of the prior art outer electron beam spots 53*a* and 53*c* shown in FIG. 7 are eliminated to provide the circular electron beams 52*a*, 52*b* and 52*c* of FIG. 10. The arrangements of FIGS. 15 and 16 thus operate to correct for spherical aberration in the electron beams arising from the asymmetric electrostatic focus field applied to the beams as they are focused on the CRT's display screen. The approaches shown in FIGS. 15 and 16 can also be used in combination with the asymmetric aperture approaches shown in the sectional views of FIGS. 8 and 9 to correct for the asymmetric electrostatic focus field to provide circular electron beam spots on the display screen.

Figure 17A:
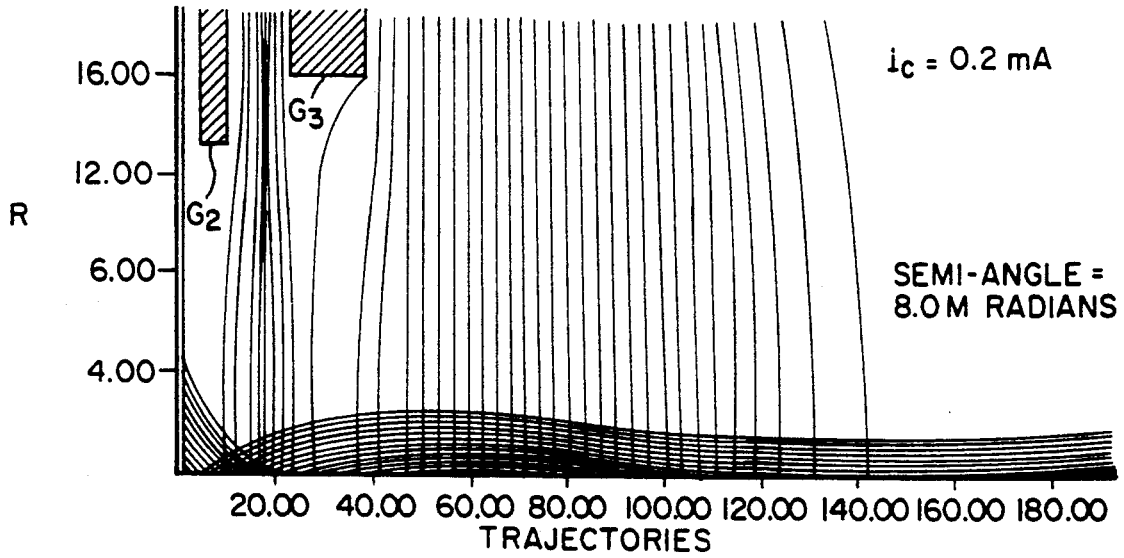
Fig. 17a (PRIOR ART)
FIG. 17*a* is a simplified schematic diagram of the BFR portion in the vicinity of the $G_2$ and $G_3$ electrodes of a typical prior art electron gun illustrating various trajectories of electrons in the electron beam.
Figure 17B:
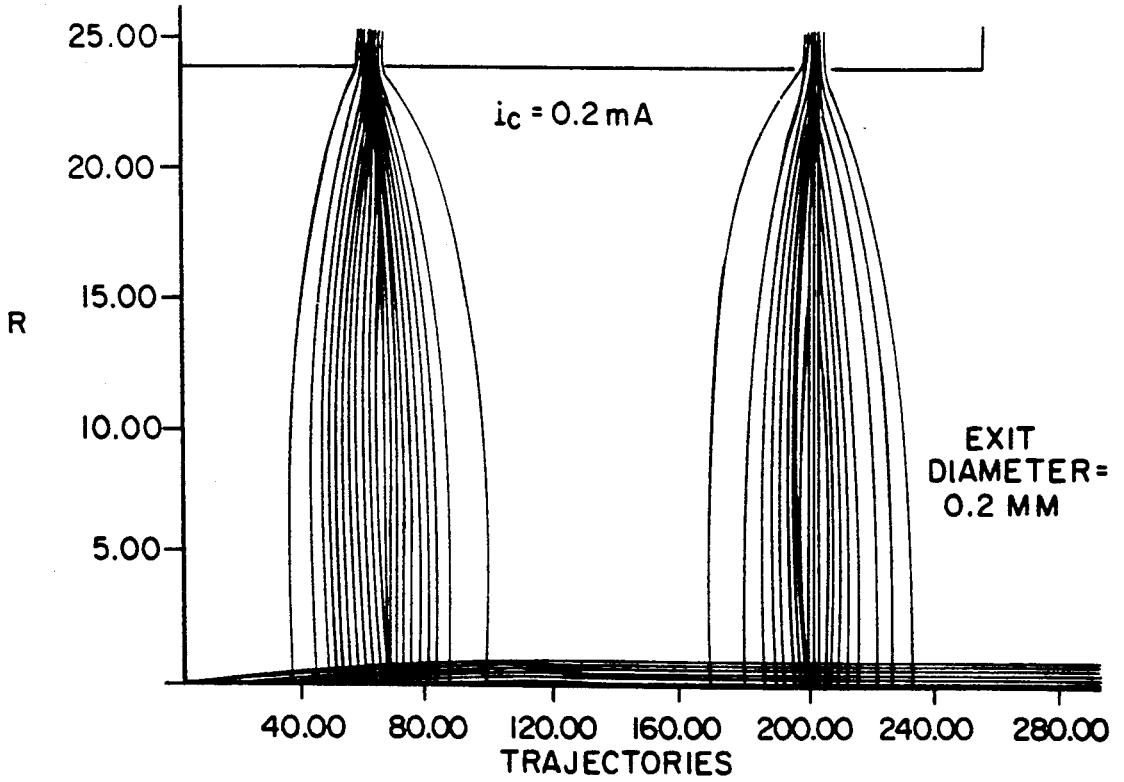
Fig. 17b (PRIOR ART)
FIG. 17*b* is a simplified schematic diagram illustrating the influence of the electrostatic focusing field on the electron beam in the high voltage focusing portion of a prior art electron gun.

In electron gun design, the electron beam angle is governed by the electron gun's beam forming region (BFR) in the vicinity of the $G_2$ and $G_3$ electrodes. In this inventive deflection lens electron gun design, if the BFR is optimized for high beam current ($i_c \geqq 2$ mA), at low currents ($i_c \leqq 0.5$ mA) the beam angle will become too small. FIG. 17*a* is a simplified schematic diagram of the BFR portion in the vicinity of the $G_2$ and $G_3$ electrodes of a typical prior electron gun illustrating various trajectories of electrons in the electron beam. The small size of the beam angle in the prior art electron gun is shown in FIG. 17*b* which is a simplified schematic diagram illustrating the influence of the electrostatic focusing field on the electron beam in the high voltage focusing portion of the prior art electron gun. From FIG. 17*a* it can be seen that there is a single beam cross-over in the BFR of the prior art electron gun. By using conventional BFR design in the electron gun of the present invention focus tracking will be a potential problem because the optimum focus voltage varies with changes in beam current.

Figure 18A:
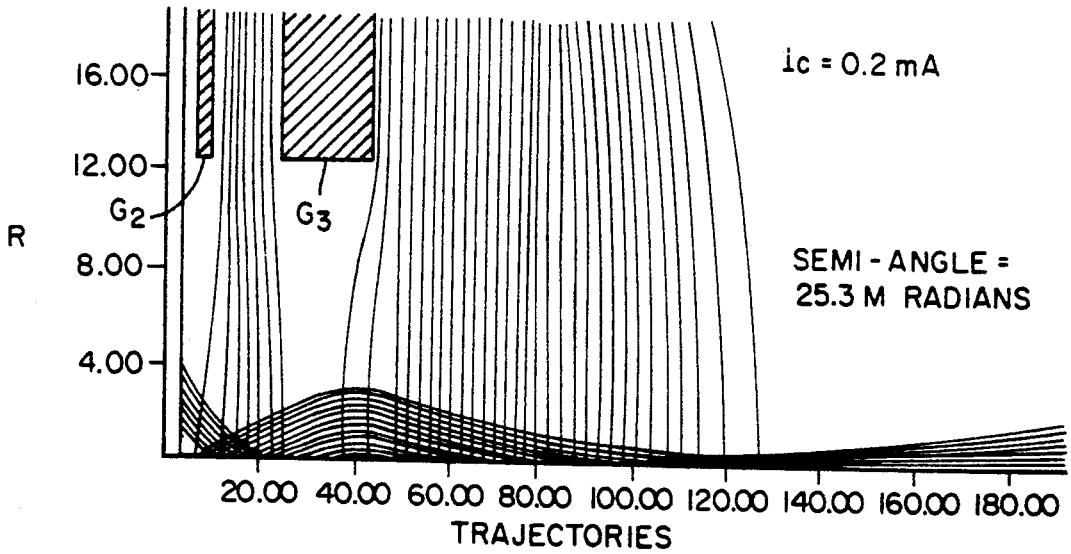
FIG. 18*a* is a simplified schematic diagram of the BFR portion of the inventive electron gun illustrating the various trajectories of electrons in the electron beam and showing a second beam crossover in the BFR.
Figure 18B:
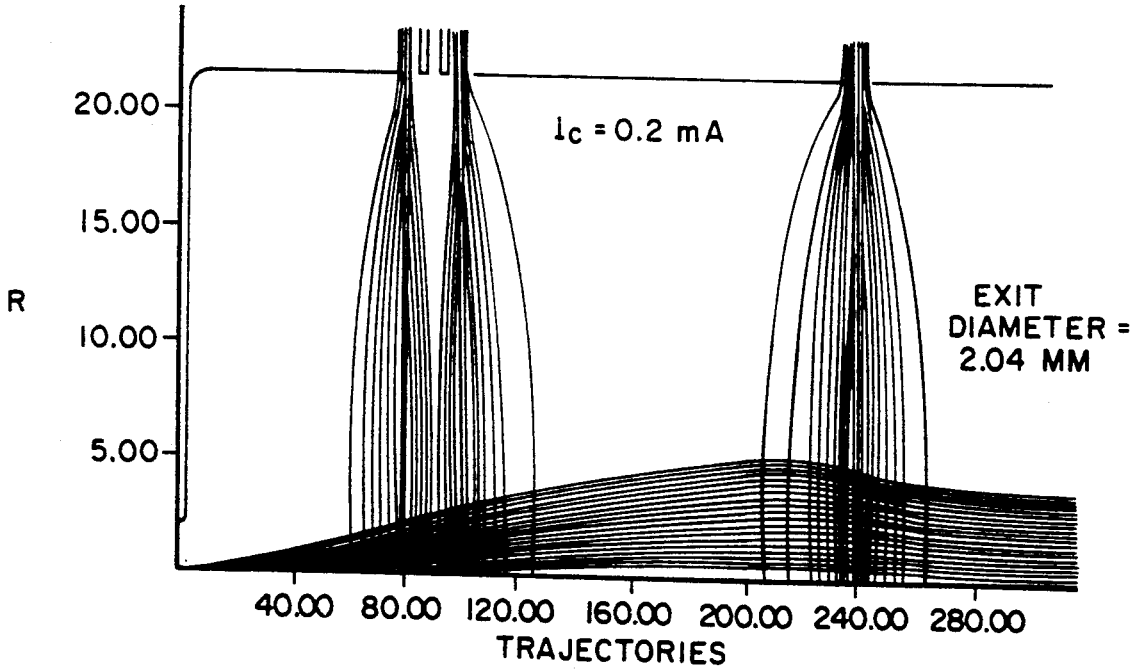
FIG. 18*b* is a simplified schematic diagram illustrating the influence of the electrostatic focusing field on the electron beam in the high voltage focusing portion of the inventive electron gun.

In the present invention, this potential problem is avoided by providing a $G_2/G_3$ electrode electrostatic focusing field E of high strength, e.g., between 270 v/mil and 450 v/mil and reduced $G_3$ aperture size. This high strength electrostatic field creates a second beam crossover at low beam current as shown in FIG. 18*a* which is a simplified schematic diagram of the BF portion of the inventive electron gun illustrating various trajectories of electrons in the electron beam and showing a second beam crossover in the BFR. FIG. 18*b* is a simplified schematic diagram illustrating the influence of the electrostatic focusing field on the electron beam in the high voltage focusing portion of the inventive electron gun. A comparison of FIGS. 17*b* and 18*b* shows that the low current electron beam angle is much larger in the inventive electron gun than in the prior art electron gun. By providing a high strength $G_2/G_3$ electrostatic focusing field in the BFR, a second beam crossover is provided in the BFR of the inventive electron gun for optimizing low current beam angle and minimizing the focus tracking problem.

There has thus been shown an electron beam deflection lens for use in the main focus lens in a color CRT which allows for simultaneous and spatially coincident focusing and deflection of the CRT's electron beams. By positioning one or more electrodes of the CRT's main focus lens on an inner surface of the CRT's glass envelope, the main focus lens may be positioned within the deflection yoke's magnetic field so as to locate the deflection center of the beam within the focal point of the main focus lens in forming a beam deflection lens. The deflection lens not only focuses the beam on the CRT's display screen, but also increases beam deflection sensitivity as the beam is deflected by the yoke. The coincidence of the beam focus and deflection regions reduces the beam "throw distance" (field-free region) and also beam space charge effect and consequently improves the beam spot on the CRT's display screen. Positioning a focus electrode (or electrodes) on the CRT's neck or funnel portion increases the equivalent diameter of the main focus lens which reduces lens spherical aberration on the beam, while co-locating the beam focus and deflection regions also allows for shorter CRT lengths.

While particular embodiments of the present invention have been shown and described, it will be obvious to those skilled in the art that changes and modifications may be made without departing from the invention in its broader aspects. For example, while the electron beam deflection lens of the present invention is described herein as incorporated in a six (6) electrode electron gun, this invention is not limited to use in this type of electron gun, but may be employed in virtually any of the more common multi-beam electron guns. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An inline electron gun for directing a plurality of electron beams along an axis onto a display screen in a color cathode ray tube (CRT) having a neck portion and a frusto-conical funnel portion disposed intermediate said neck portion and said display screen, said CRT further including a magnetic deflection yoke disposed generally intermediate said neck and funnel portions for providing a magnetic deflection region for deflecting said electron beams across said display screen in a raster-like manner, said electron gun comprising:

a source of energetic electrons;

low voltage beam forming means disposed adjacent said source of energetic electrons and within the neck portion of the CRT for forming the energetic electrons into a plurality of electron beams directed along said axis; and high voltage focus means disposed in the magnetic deflection region and intermediate said beam forming means and the display screen for providing a common aperture electrostatic focus region for the plurality of electron beams for focusing the electron beams on the display screen, wherein said magnetic deflection region and said electrostatic focus region overlap and are coincident, wherein said focus means includes a first charged electrode defining a first common aperture aligned with said axis through which the electron beams are directed and disposed intermediate said magnetic deflection yoke and said display screen and adjacent to an inner surface of the funnel portion of the CRT.

2. The electron gun of claim 1 wherein said first charged electrode is conductive coating applied to the inner surface of the funnel portion of the CRT.

3. The electron gun of claim 1 wherein said first charged electrode is a frusto-conical metallic grid disposed immediately adjacent to the inner surface of the funnel portion of the CRT and including a center aperture through which the electron beams are directed.

4. The electron gun of claim 1 wherein said focus means further includes a second charged electrode defining a second common aperture aligned with said axis through which the electron beams are directed and disposed intermediate said beam forming means and said first charged electrode and within said magnetic deflection region.

5. The electron gun of claim 4 wherein said second charged electrode is a conductive coating applied to the inner surface of the neck portion of the electron gun.

6. The electron gun of claim 4 wherein said second charged electrode is a metallic grid disposed in the neck portion of the CRT.

7. The electron gun of claim 6 wherein said second charged electrode is generally cylindrical having a longitudinal axis coincident with the electron beam axis.,

8. The electron gun of claim 4 further comprising a resistive coating disposed on an inner surface of the CRT intermediate said first and second electrodes to prevent high voltage arcing therebetween.

9. The electron gun of claim 1 wherein said focus means has a focal point and said magnetic deflection region is characterized as having a beam deflection center, and wherein said beam deflection center is disposed within the focal point of said focus means to provide increased electron beam deflection sensitivity.

10. The electron gun of claim 4 further comprising static convergence correction means disposed in the neck portion of the CRT for applying a horizontal asymmetric electrostatic focus field to said electron beams for converging the electron beams on the CRT's display screen.

11. The electron gun of claim 10 wherein said convergence correction means includes a plurality of offset apertures for passing a respective one of the electron beams.

12. The electron gun of claim 11 wherein said electron gun includes a plurality of spaced charged electrodes, and wherein said offset apertures are disposed in adjacent charged electrodes.

13. The electron gun of claim 10 further comprising spherical aberration correction means including a charged electrode having first and second horizontally asymmetric outer apertures through which respective outer electron beams pass for correcting for spherical aberration in the outer electron beams.

14. The electron gun of claim 13 wherein said charged electrode is disposed in a neck portion of the CRT.

15. The electron gun of claim 10 further comprising spherical aberration correction means including first and second opposed notched lateral portions in said second charged electrode, wherein each notched lateral portion is disposed adjacent a respective outer electron beam for applying a horizontal asymmetric electrostatic field to outer electron beams for providing outer spherical aberration corrected electron beam spots on the display screen.

16. The electron gun of claim 15 wherein said second charged electrode includes a support cup disposed on a forward portion thereof and wherein said notched portions are disposed in opposed lateral portions of said support cup.

17. The electron gun of claim 10 further comprising spherical aberration correction means including first and second opposed lateral extensions of said first charged electrode adjacent two outer electron beams for applying a horizontal asymmetric electrostatic field to said two outer electron beams for providing outer spherical aberration corrected electron beam spots on the display screen.

18. The electron gun of claim 17 wherein said first and second extensions of said first charged electrode are directed towards said second charged electrode.

19. The electron gun of claim 18 further comprising a resistive coating disposed on an inner surface of the CRT envelope intermediate said first and second electrodes to prevent arcing therebetween, and wherein said first and second extensions of said first charged electrode are formed by first and second opposed lateral slots in portions of said resistive coating disposed over adjacent portions of said first charged electrode adjacent to said second charged electrode.

20. The electron gun of claim 1 wherein said energetic electrons form a first electron beam crossover of said axis, and wherein said low voltage beam forming means includes a pair of adjacent charged electrodes for applying a strong electrostatic focusing field to said electron beams for forming a second electron beam crossover of said axis at low beam current for improved focus tracking.

21. The electron gun of claim 20 wherein said adjacent charged electrodes are a $G_2$ electrode and a $G_3$ electrode.

22. The electron gun of claim 21 wherein said electrostatic focus field is 270–450 v/mil in strength.

23. For use in a color cathode ray tube (CRT) having a glass envelope including a neck portion, a frustoconical funnel portion and a display screen, wherein a plurality of inline electron beams are directed onto a phosphor layer disposed on an inner surface of said display screen for providing a video image, and wherein said electron beams are directed through a magnetic deflection region formed by a deflection yoke disposed generally intermediate the neck and funnel portions of the CRT's glass envelope for deflecting said electron beams across said display screen in a raster-like manner, a deflection lens comprising:

a first charged electrode disposed intermediate the deflection yoke and the display screen and adjacent to an inner surface of the funnel portion of the CRT's glass envelope and charged to a voltage $V_A$, said first charged electrode having a first common aperture through which said electron beams pass; and a second charged electrode disposed in the neck portion of the CRT's glass envelope and charged to a voltage $V_F$ and having a second common aperture through which said electron beams pass, wherein said first and second electrodes apply an electrostatic focus field to the electron beams for focusing said beams on the display screen, and wherein said electrostatic focus field is disposed in the magnetic deflection region for simultaneous and coincident focusing and deflection of the electron beams on the display screen.

24. The deflection lens of claim 23 further comprising resistive means disposed on an inner surface of the glass envelope intermediate said first and second electrodes for preventing arcing therebetween.

25. The deflection lens of claim 24 wherein said resistive means comprises a high impedance coating disposed over a portion of said first electrode adjacent to said second electrode.

26. The deflection lens of claim 23 wherein $V_A > V_F$.

27. The deflection lens of claim 26 wherein $V_A$ is on the order of 25 kV and $V_F$ is on the order of 7 kV.

28. The deflection lens of claim 23 wherein the CRT has a longitudinal axis coincident with a center electron beam, and wherein said deflection lens is characterized as having a focal point disposed on said axis and the magnetic deflection region is characterized as having an electron beam deflection center, and wherein said electron beam deflection center is disposed within the focal point of said deflection lens to provide increased electron beam deflection sensitivity.

29. The deflection lens of claim 23 wherein said first charged electrode comprises a conductive coating disposed on the inner surface of the funnel portion of the glass envelope.

30. The deflection lens of claim 29 wherein said conductive coating is metallic or carbon-based and extends from adjacent the magnetic deflection yoke to the display screen of the CRT.

31. The deflection lens of claim 23 wherein said first charged electrode is a frusto-conical metallic grid disposed immediately adjacent to an inner surface of the funnel portion of the glass envelope.

32. The deflection lens of claim 31 wherein aid frusto-conical metallic grid extends from adjacent the magnetic deflection yoke to the display screen.

33. The deflection lens of claim 23 wherein said CRT further includes an anode button coupled to an anode voltage source and extending through the glass envelope, and wherein said first charged electrode is coupled to said anode button and is charged to said anode voltage.

34. The deflection lens of claim 23 further comprising a resistive coating disposed on an inner surface of the glass envelope in the neck portion thereof and extending over an aft portion of said first charged electrode for preventing arcing between said first charged electrode and said second charged electrode.

35. The deflection lens of claim 23 wherein said inline electron beams include a center and two outer beams, said deflection lens further comprising convergence correction means for applying a horizontal asymmetric electrostatic field to said two outer electron beams for converging said two outer electron beams on said center electron beam on the display screen.

36. The deflection lens of claim 35 wherein said convergence correction means includes first and second pairs of offset apertures through which said two outer electron beams are directed.

37. The deflection lens of claim 36 wherein an aperture in each of said first and second pairs of offset apertures is disposed in said second charged electrode.

38. The deflection lens of claim 23 wherein said inline electron beams include a center and two outer beams, said deflection lens further comprising horizontal spherical aberration correction means for applying a horizontal asymmetric electrostatic field to said two outer electron beams and providing outer spherical aberration corrected electron beam spots on the display screen.

39. The deflection lens of claim 38 wherein said spherical aberration correction means includes asymmetrical outer apertures in said second electrode.

40. The deflection lens of claim 38 wherein said spherical aberration correction means includes first and second opposed notched lateral portions in said second charged electrode, wherein each notched lateral portion is disposed adjacent a respective outer electron beam for applying an asymmetric electrostatic field to a respective outer electron beam.

41. The deflection lens of claim 40 wherein said second charged electrode includes a support cup disposed on a forward portion thereof and wherein said notched portions are disposed in opposed lateral portions of said support cup.

42. The deflection lens of claim 38 wherein said spherical aberration correction means includes first and second opposed lateral extensions of said first charged electrode adjacent said two outer electron beams for applying an asymmetric electrostatic field to said two outer electron beams.

43. The deflection lens of claim 42 wherein said first and second extensions of said first charged electrode are directed toward said second charged electrode.

44. The deflection lens of claim 24 wherein said electrostatic focusing field is 270–450 v/mil in strength.

45. For use with a color cathode ray tube (CRT) wherein a plurality of electron beams are directed onto phosphor elements disposed on an inner surface of a display screen for providing a video image, said CRT including an apertured color selection electrode disposed adjacent said display screen for passing each of said electron beams onto selected phosphor elements, said CRT further including coincident beam magnetic deflection and beam focus regions wherein said electron beams are simultaneously deflected across said display screen in a raster-like manner and focused on said display screen to provide a dynamic deflection center effect on said electron beams, wherein a deflection center of sid electron beams moves along a centerline axis generally transverse to said display screen and extending through the center of said display screen giving rise to misfocusing of the electron beams on the display screen, an arrangement for activating said phosphor elements whereupon said phosphor elements are responsive to an electron beam incident thereon for emitting phosphorescent light, said arrangement comprising:

a source of light disposed on the centerline axis of the display screen;

displacement means coupled to said source of light for moving said source of light along said axis whereupon light transmitting the apertures in the color selection electrode illuminates phosphor elements on the inner surface of the display screen in activating said phosphor elements; and ray blocking means disposed intermediate said light source and the display screen for blocking light from selected ones of said phosphor elements disposed within first designated area on the display screen while permitting light to illuminate and activate selected others of said phosphor elements disposed within second designated areas on the display screen as said light source is displaced along said axis to accommodate the dynamic deflection center effect on said electron beams and improve electron beam focusing on the display screen.

* * * * *

UNITED STATES PATENT AND TRADEMARK OFFICE

CERTIFICATE OF CORRECTION

PATENT NO. : 5,204,585

DATED : April 20, 1993

INVENTOR(S) : Hsing-Yao Chen

It is certified that error appears in the above-identified patent and that said Letters Patent is hereby corrected as shown below:

| COLUMN | LINE | |
|---|---|---|
| 1 | 7 | "a" should be --an--. |
| 2 | 39 | "timevarying" should be --time-varying--. |
| 2 | 63 | "Insert --,--, after "voltage". |
| 5 | 17 | "($d_x$=" should be --($d_s$=)--. |
| 12 | 64 | "il" should be --11--. |
| 14 | 44 | "I" should be --In--. |
| 17 | 12 | "BF" should be --BFR--. |
| 18 | 54 | Delete "," after "axis." |
| 19 | 68 | "frustoconi-" should be --frusto-coni---. |
| 22 | 21 | "sid" should be --said--. |

UNITED STATES PATENT AND TRADEMARK OFFICE

CERTIFICATE OF CORRECTION

PATENT NO. : 5,204,585

DATED : April 20, 1993

INVENTOR(S) : Hsing-Yao Chen

It is certified that error appears in the above-identified patent and that said Letters Patent is hereby corrected as shown below:

| COLUMN | LINE | |
|---|---|---|
| 22 | 34 | "transmitting" should be --transitting--. |
| 22 | 41 | "area" should be --areas--. |

Signed and Sealed this

Twenty-first Day of December, 1993

*Attest:*

*Attesting Officer*

BRUCE LEHMAN

*Commissioner of Patents and Trademarks*